US006102224A

United States Patent [19]

Sun et al.

[11] Patent Number: 6,102,224

[45] Date of Patent: Aug. 15, 2000

[54] AROMA RELEASE BOTTLE AND CAP

[75] Inventors: Rickson Sun, Palo Alto, Calif.; Harald Quintus-Bosz, Arlington, Mass.; Peter Given, Ridgefield, Conn.; Rodrigo Pineiro, Bethlehem, Pa.; Audrey Morrison, Locust Valley, N.Y.

[73] Assignee: PepsiCo., N.C.

[21] Appl. No.: 08/992,580

[22] Filed: Dec. 17, 1997

[51] Int. Cl.[7] ..... B65D 43/00

[52] U.S. Cl. ..... 215/252; 215/329

[58] Field of Search ..... 428/905, 402.2, 428/402.24; 215/356, 230, 252, 329

[56] References Cited

U.S. PATENT DOCUMENTS

| | | | |
|---|---|---|---|
| 3,017,047 | 1/1962 | Payson et al. | 215/356 X |
| 4,169,069 | 9/1979 | Unger et al. . | |
| 4,489,841 | 12/1984 | Thompson | 215/230 X |
| 4,720,417 | 1/1988 | Sweeny et al. . | |
| 4,720,423 | 1/1988 | Fraser . | |
| 5,135,123 | 8/1992 | Nairn et al. | 215/252 |
| 5,381,914 | 1/1995 | Koyama et al. | 215/348 X |
| 5,542,557 | 8/1996 | Koyama et al. | 215/347 |
| 5,722,547 | 3/1998 | Shankland | 215/230 |

FOREIGN PATENT DOCUMENTS

| | | | |
|---|---|---|---|
| 2105194 | 3/1994 | Canada . | |
| 995925 | 6/1965 | United Kingdom | 215/252 |
| 92/03348 | 3/1992 | WIPO | 215/252 |

*Primary Examiner*—Stephen P. Garbe
*Assistant Examiner*—Robin A Hylton
*Attorney, Agent, or Firm*—Fitzpatrick, Cella, Harper & Scinto

[57] ABSTRACT

A method and apparatus for delivering an aroma when a bottle is opened is provided. An aromatic substance is placed on the bottle neck and/or the cap, and the aroma is released when the cap is removed from the bottle. A preferred embodiment uses a scratch-and-sniff material to contain the aroma. The material is scratched when the cap is removed, releasing the aroma.

27 Claims, 6 Drawing Sheets

AROMA RELEASE BOTTLE AND CAP

BACKGROUND OF THE INVENTION

1. Field of the Invention

The present invention relates to the use of aromas to enhance the experience of drinking a beverage. More specifically, it relates to systems for releasing a flavor enhancing aroma or scent when a beverage bottle is opened.

2. Background of the Invention

The beverage industry, and particularly the soft drink segment of that industry, is highly competitive. Manufacturers take great care and make substantial efforts to formulate their products for quality, to differentiate their products from one another, and to make consumption of a given soft drink more enjoyable for their consumers.

An important contribution to the overall soft drink experience is the taste of the beverage, which is determined by its ingredients. Traditionally, competing products are distinguished by the differing natures of their specific recipes which produce distinctive flavors and taste sensations.

Another contribution to the overall soft drink experience is the beverage's aroma. When a beverage container is first opened and the beverage is poured, the beverage's aroma is smelled by the consumer. Because a beverage's ingredients usually determine its aroma, those ingredient are selected to provide a pleasant aroma, as well as the desired taste characteristics.

Although aroma can have a tremendous impact on the sensation of flavor, it has been difficult to make use of this phenomenon without modifying the ingredients and also affecting the taste of the beverage.

In other fields, specially designed containers have been used to release an aromatic substance when the container is opened. For example, U.S. Pat. No. 4,717,017 describes a cigarette package in which an aromatic substance is released when the package's overwrap tear strip is pulled. This mechanism is used to release an aroma of freshness or to add flavorings to the cigarettes in the pack.

U.S. Pat. No. 5,249,676 is an other example of a package that releases a burst of aroma when the package is opened. That package relies on an aroma that is kept contained behind a barrier film until the package is opened. U.S. Pat. No. 4,720,423 describes another package that releases a fragrant liquid from microcapsules when a tear strip is removed from the package.

U.S. Pat. No. 4,858,758 is directed to bottle for housing granular bleach. A fragrant material is provided inside the cap, isolated from the bleach by an apertured barrier that allows the fragrance to escape into the bottle, but does not allow the bleach granules to contact the fragrant material.

None of these mechanisms, however, are suitable for beverage containers, because overwraps of the type disclosed in these patents are not used with beverage bottles. Moreover, an overwrap that would be strong enough to withstand the mechanical stress experienced by beverage bottles on supermarket shelves would probably be difficult to open and expensive to manufacture. Finally, the fragrancing system for granular bleach bottles is not suitable for beverage bottles because the beverage would seep past the apertured barrier and come into contact with the fragrant material, spoiling the beverage.

U.S. Pat. No. 5,635,229 is directed to a beverage container with an affixed scent disbursement means. The '229 patent describes using a scent-infused absorbent material contained within a package that can be opened to release the scent. The release of scent, however, only occurs when the scent packaging is removed, and does not occur automatically when the container is opened. The '229 patent also describes using scent-infused absorbent material inside a flip-top cap. While the aroma is released automatically when the flip-top cap is opened, it is difficult to incorporate tamper resistant features into flip top caps, and they are also more expensive than traditional twist off caps.

SUMMARY OF THE INVENTION

Accordingly, it is an object of the present invention to release or deliver an aroma in the vicinity of a beverage bottle when the bottle cap is removed from the bottle.

Another object of the invention is to provide an aroma delivery system for a beverage bottle which is relatively simple in construction and economical to manufacture.

Yet another object of the invention is to enable a beverage manufacturer to control the aroma experienced by a beverage consumer when a bottle is opened, without modifying the recipe of the beverage itself.

In accordance with an aspect of the present invention, an aroma delivery method and apparatus is provided in which a material containing microencapsulated liquid aroma is affixed to either the top or the cap (or both) of a beverage bottle. The aroma microcapsules remain intact while the cap remains on the bottle, and at least some are burst when the cap is initially twisted to open the bottle.

In accordance with another aspect of the present invention, an aroma delivery apparatus is provided in which a liquid aromatic substance is contained within a closed cavity in the cap while the cap remains on the bottle, and the cavity opens and spills its contents when the cap is initially twisted to open the bottle.

BRIEF DESCRIPTION OF THE DRAWING

The above, and other objects, features, and advantages of the present invention will be apparent in the following detailed description of illustrative embodiments thereof, which is to be read in connection with the accompanying drawings, wherein.

DETAILED DESCRIPTION OF THE PREFERRED EMBODIMENTS

Figure 1:
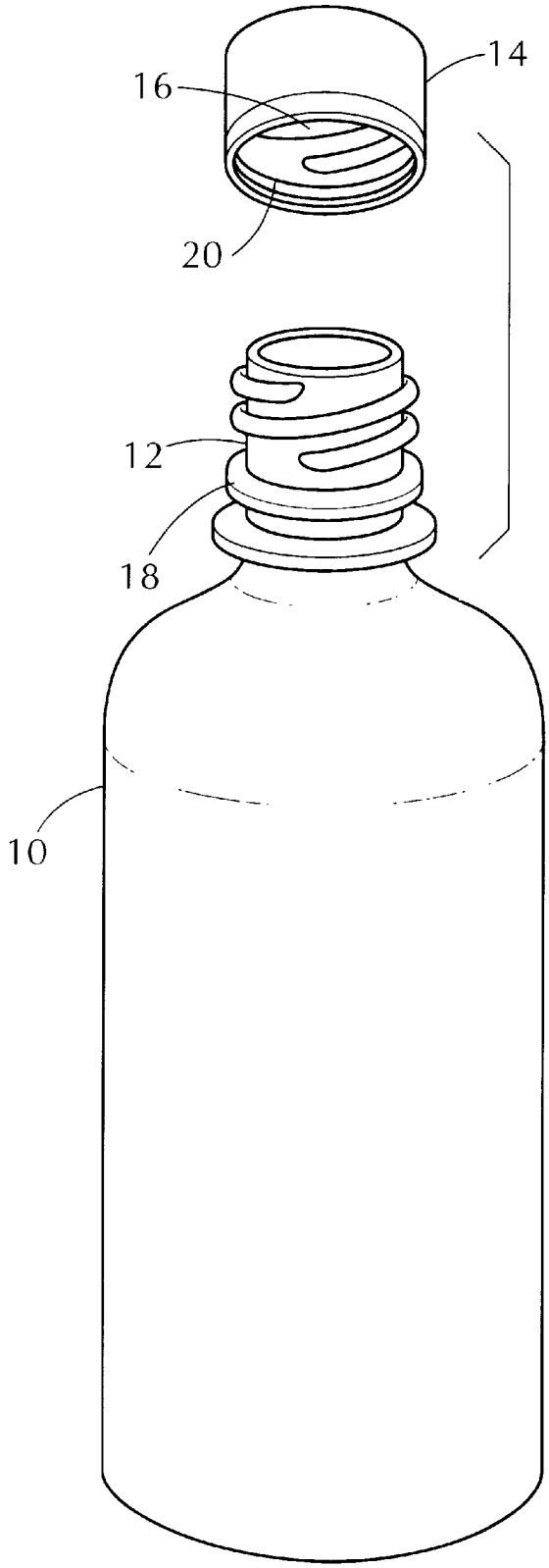
FIG. 1 PRIOR ART
FIG. 1 is a perspective view of a conventional beverage bottle and cap.
Figure 1A:
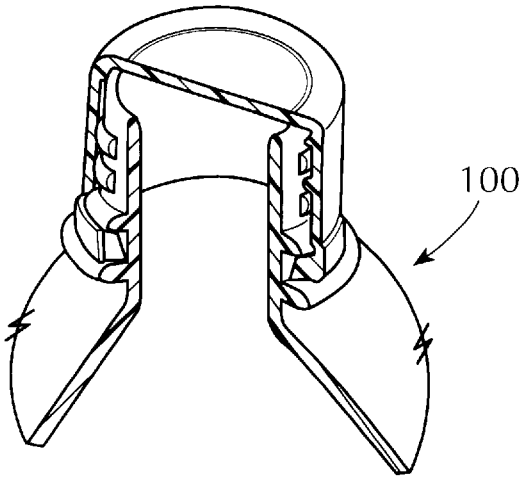
FIG. 1A is a partial perspective view, with parts broken away, illustrating a first embodiment of a bottle top and cap in accordance with the present invention.

Referring now to the drawings in detail, and initially to FIGS. 1 and 1A, a conventional beverage container 10 is illustrated which has a threaded neck 12 to which a plastic cap 14 is threadedly engaged to keep the neck sealed. As is understood by those skilled in the art, neck 12 has a spiral thread 15 formed on it which engages one or more complementary threads 16 formed on the inner surface of the cap 14. In addition, neck 12 has an annular ring or flange 18 projecting from it which engages a complementary inwardly projecting ring on a tamper band 20 that is secured to the base of the cap in a well known manner. The tamper band is designed to break off when the cap is twisted to open the bottle. The present invention makes use of this general construction of beverage bottles to release an aroma material when the bottle is opened to enhance the enjoyment of the beverage.

Figure 1B:
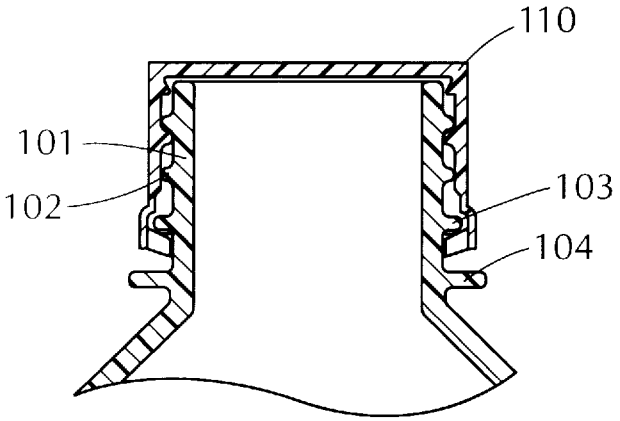
FIG. 1B is a cross sectional view taken of the cap and bottle neck shown in Fig. 1A.
Figure 1C:
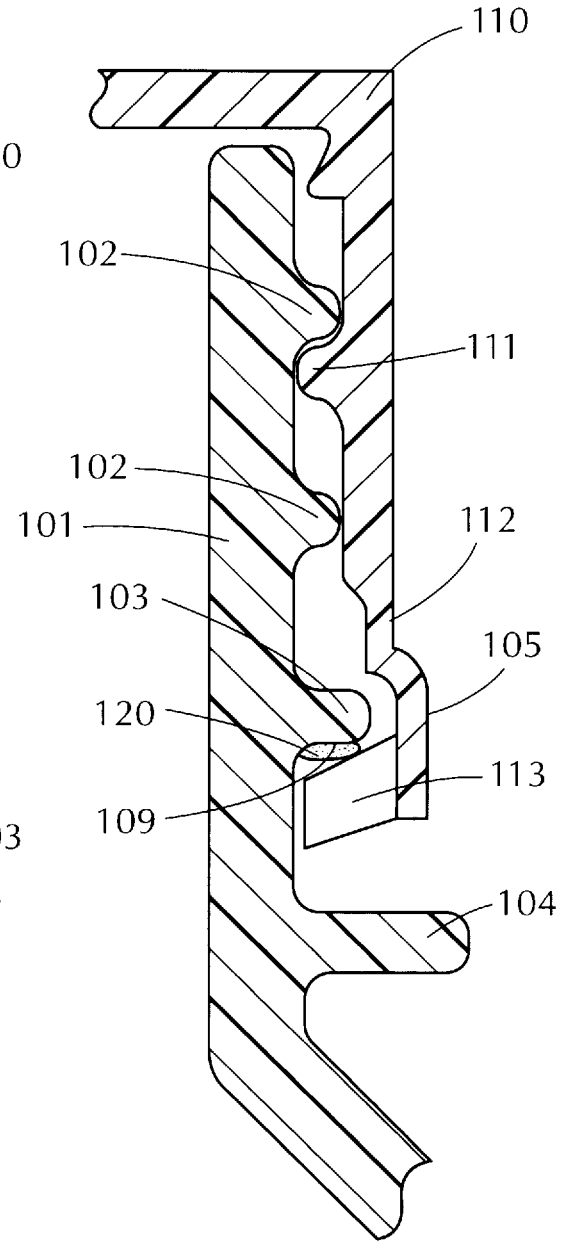
FIG. 1C is an enlarged partial view of the bottle top and cap shown in FIG. 1B.

As seen in FIGS. 1A–1C, in accordance with one embodiment of the present invention, a soda bottle 100 is provided which includes a generally conventional top or neck 101 closed by a cap 110. Neck 101 has a spiral thread 102 formed on its outer surface and an annular ring or flange 103 projecting from it below the threads 102. Cap 110 has a tamper band 105 with an internal flange 113. The neck of the bottle also includes a second flange 104, which helps the consumer's hand to support the bottle as the beverage is poured.

Cap 110 includes a complementary internal thread 111 which mates with the thread 102 on the bottle neck 101 in the known manner. Tamper band 105 is connected to the bottle cap 110 by a separation region 112 also in manner known to those skilled in the art, e.g. including a ring of perforations. Separation region 112 is designed to tear or rupture (e.g. along the perforations) when cap 110 is removed, leaving the tamper band 105 behind, below the flange 103.

In accordance with this embodiment of the invention, a layer of material 120 containing microencapsulated liquid aroma is applied to the underside of flange 103 on neck 101. Preferably, the microencapsulated material 120 is applied to flange 103 as a slurry, and allowed to dry. This material is of the type in which the microcapsules burst when scratched, releasing the aroma of the liquid contained in them. This type of material is commonly known as "scratch-and-sniff". The microencapsulated aroma material is made by a number of vendors, including, for example, the Ronald T. Dodge Co. of Dayton, Ohio, 45459. The manufacturer typically uses an aromatic essence oil, encapsulates it in microcapsules, and mixes the microcapsules with a carrier and water to form a slurry. One suitable carrier is polyvinyl alcohol (PVA), although other carriers, including other water soluble polymer matrixes, may be used as well.

The terms microcapsules and microencapsulated, as used herein, relate to materials that surround the aromatic material in tiny capsules. These capsules can range from the sub-micron range to the millimeter range. They should be large enough so that they break when they are scratched, but small enough so that they are not excessively fragile, which would cause them to break prematurely. Preferably, the diameter of the capsules should be between 20 and 300 microns, and most preferably between 60 and 80 microns.

Polyethylene terephthalate (PET) is a commonly used material for beverage bottles, particularly soda bottles. It has been found that the typical microencapsulated material does not adhere well to PET. Thus, the surface of PET bottles must be prepared before the microencapsulated material is applied to the bottles.

One successful way found by applicants for preparing PET for the application of a microcapsule slurry is to treat the surface with a primer that enables the microencapsulated material to adhere to PET. PRO-KOTE Primer, which is made by Sun Chemical Corp, Carlstadt, N.J. 07072, is one example of a primer that is suitable for this purpose. PRO-KOTE contains isopropyl alcohol (1.1% by weight), ethyl alcohol (11.9%), N-propyl acetate (46.1%), and propylene glycol monomethyl ether (6.5%). The PRO-KOTE may be applied to the target region of the bottle by, for example, spraying it with a pulsed spray gun or painting it. It ordinarily evaporates within a few seconds. PRO-KOTE is FDA approved for food package contact, as is the microencapsulated material described above.

Another successful way found by applicants to prepare the PET surface for a microcapsule slurry is by roughening the surface using laser etching. The process of laser etching is well known to those in bottling industry; it has been used in the past to put graphics and date codes on PET bottles. The same equipment used for those purposes can also be used, with ordinary adjustments, to roughen the surface of the PET so that the material 120 will adhere to the bottle. Yet another way to prepare the PET surface for a microcapsule slurry is by roughening the surface by physical abrasion, by, for example, rubbing it with an abrasive.

Once the surface has been prepared, the microcapsule slurry is applied to the prepared region of the PET bottle by, for example, spraying it with a pulsed spray gun or painting it. The slurry is then allowed to dry. When the slurry dries, the water in it evaporates and the PVA forms a film that holds the microcapsules in place. The dried microencapsulated material is water resistant, can survive bottle washing and filling operations, and can also survive being immersed in boiling water for two minutes.

In this embodiment of the invention, a portion of the undersurface 109 of flange 103 is laser etched (or treated with PRO-KOTE Primer) and then the microencapsulated aroma material is applied to it as a slurry. The slurry dries, forming microencapsulated layer 120. Once the slurry is dried, cap 110 is assembled onto the neck of the bottle top 101 in the bottling plant in the conventional manner.

The cap is installed tightly and will not rotate on the neck unless forced. When the bottle is delivered to the consumer and opened by twisting, the internal flange 113 of tamper band 105 rubs against microencapsulated layer 120 on the underside 109 of flange 103. As the cap is twisted, the tamper band is forced upward, against the flange 103, and rubs against layer 120. This rubbing action causes the microcapsules in layer 120 to break, releasing the aroma. As the cap is rotated further, the separation region 112 that joins cap 110 to the tamper band 105 will tear, leaving tamper band 105 behind, below the flange 103. Cap 110 is then rotated further and removed from the bottle. The contents of the bottle can then be consumed. The aroma released in the vicinity of opened the bottle neck enhances the enjoyment of the beverage. The precise aroma used with a particular beverage will of course, vary with the beverage and generally (but not necessarily) complement and enhance the natural aroma of the beverage itself.

Figure 2A:
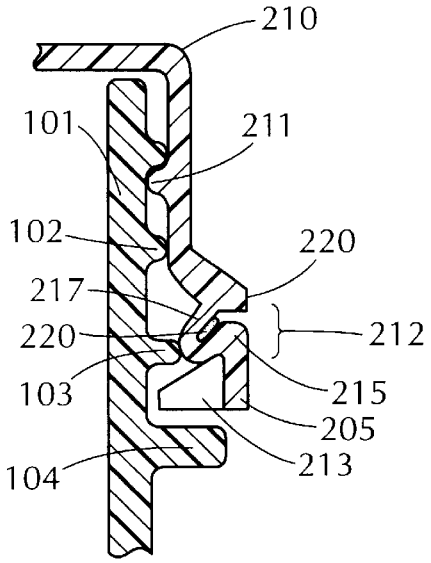
FIG. 2A is a partial sectional view, similar to FIG. 1C, of a second embodiment of a bottle top and cap in accordance with the present invention.
Figure 2B:
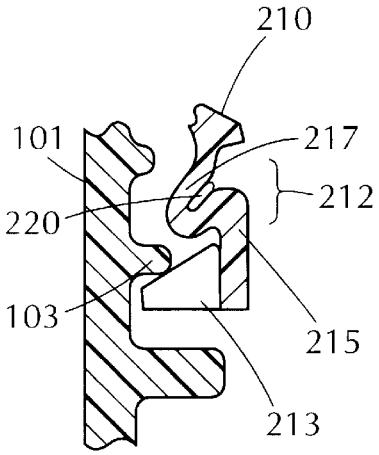
FIGS. 2B–2D are enlarged detail views of the bottle top and cap of FIG. 2A showing the sequential deformation and ultimate breakage of a portion of the cap as the cap is unscrewed to open the bottle.
Figure 2C:
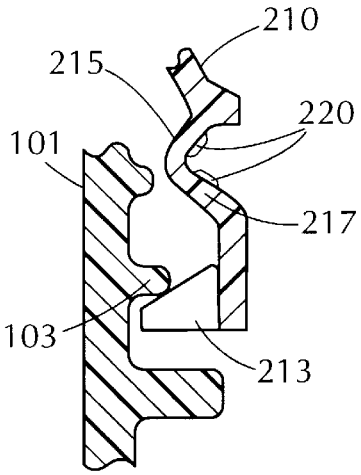

A second embodiment of the invention is illustrated in FIGS. 2A–2D. In this embodiment the bottle's neck 101, thread 102, and flanges 103 and 104 are the same as the corresponding parts in the first embodiment, described above, however the structure of the cap is changed. In this case a cap 210 is provided having a thread 211 which mates with threads 102. Cap 210 includes a tamper band 205 including an internal flange 213 which is located below flange 103 when the bottle is sealed during manufacture. Cap 210 also includes an integral flexible pleated section 212 that connects tamper band 205 to the rest of the cap 210. This pleated section is folded over on itself, as shown in FIGS. 2A and 2B. When cap 210 is twisted off the bottle it rises on neck 101 by the cooperation of the threads while tamper band 205 remains in place under flange 103. Then, the top portion 215 of pleated section 212 is pulled upwards, while the bottom portion 217 of the pleated section, connected to tamper band 205, can not move up. Thus, the pleat is pulled apart when the cap 210 is removed as shown in sequential views 2B–2D.

Figure 2D:
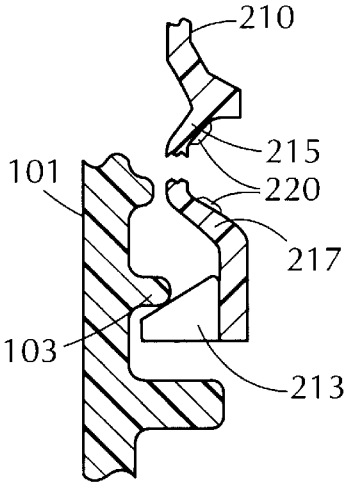

In this embodiment of the invention, the slurry of microencapsulated aroma material is applied, when wet, into the pleated section 212 of cap 210 and adheres to the two facing surfaces of pleat sections 215 and 217. When the slurry dries, it forms a layer 220 that acts like glue and holds the pleat faces together. When the pleat is pulled apart as the cap is removed, the microcapsules in layer 220 burst, releasing the aroma. As the consumer continues to twist the cap 210 off of the bottle, the pleat 212 will eventually break apart at the fold in the pleat (which may be perforated) separating portions 215, which comes up with the cap, and 217 which remains fixed to tamper band 205, as shown in FIG. 2D. Depending on the material used to make cap 210, the surface of the cap 210 may have to be prepared by laser etching or otherwise so that the microcapsule material 220 will adhere to the surfaces 215, 217 of pleat 212. In this embodiment, the microcapsules burst and release the aroma when the material 220 is pulled apart in a "snap-and-sniff" action (in contrast to the scratch-and-sniff action of the first embodiment).

Figure 3A:
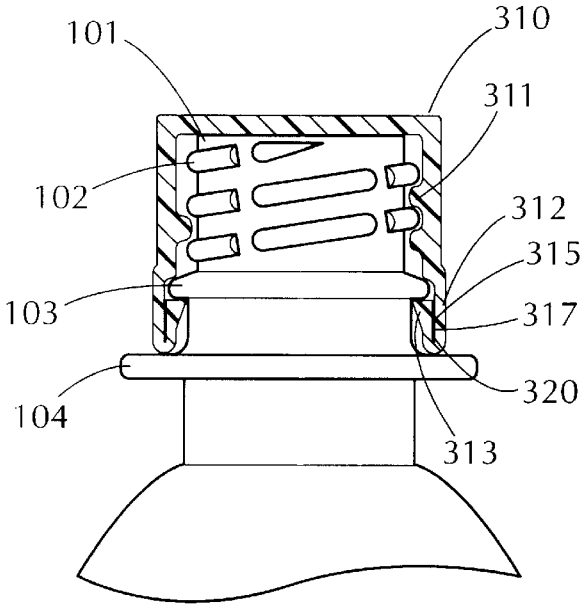
FIG. 3A is partial sectional view similar to FIG. 1B of a third embodiment of a bottle top and cap in accordance with the present invention.
Figure 3B:
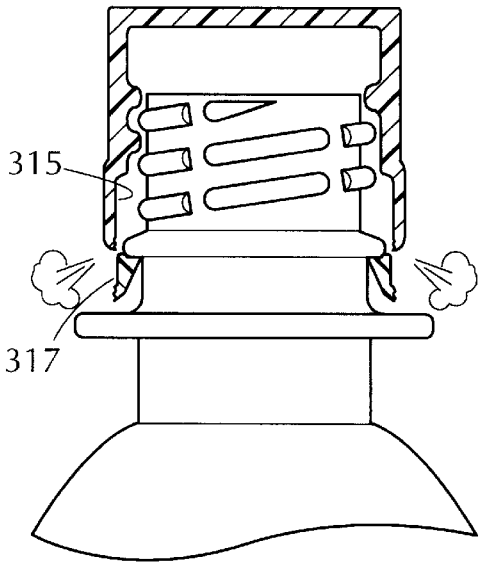
FIG. 3B is a partial detail view of the bottle top and cap shown in FIG. 3A illustrating the rupture of a portion of the cap as it is unscrewed to release aroma material.

FIGS. 3A and 3B illustrate a third embodiment of the present invention. Here again, bottle neck 101, threads 102, and flanges 103 and 104 are the same as the corresponding parts in the first embodiment, described above. In this case a cap 310 is applied to neck 101 so that the thread 311 of cap 310 mates with thread 102 of the neck.

Cap 310 includes a base or lower skirt portion 312 which has an inner annular surface 315. An inwardly extending annular shoulder member 313, which has an outer surface 317, is secured within skirt 312. A layer of microencapsulated material 320 is applied to the surfaces 315 and 317 of skirt 312 and shoulder 313 and the skirt and shoulder are assembled in the relationship shown in FIG. 3A. When the micro encapsulated material dries shoulder 313 is adhered to skirt 312 and the cap is assembled to the bottle with shoulder 313 located below bottle flange 103.

When cap 310 is twisted off the bottle, it rises on neck 101 by the cooperation of the threads. Initially, shoulder 313 will move upward together with the cap 310. But when shoulder 313 hits the under side of flange 103, the flange will prevent shoulder 313 from moving up any further. As the cap is unscrewed further, the base or skirt portion of cap 312 will be pulled up, while shoulder 313 is held down by flange 103. This action will separate the cap from the tamper ring or shoulder 313 as seen in FIG. 3B, bursting the micro-capsules contained in the layer 320. In this embodiment the microcapsules are burst by either a snap-and-sniff action when the surface 315 of the skirt 312 is pulled apart from the surface 317 of shoulder 313, or the scratch-and-sniff action of surface 315 of skirt 312 rubbing against the surface 317 of shoulder 313 as the cap is removed. Depending on the material used to make cap 310, the surfaces 315, 317 may require preparation so that the microcapsule material 320 will adhere to them, as described above.

Figure 3C:
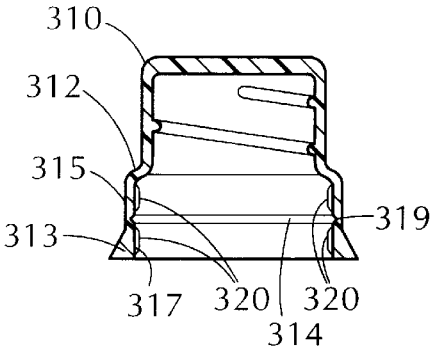
FIGS. 3C and 3D illustrate the sequence of steps performed during manufacturing of the cap shown in FIG. 3A.
Figure 3D:
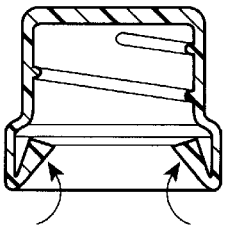

The cap 310 is made and assembled as shown in FIGS. 3C–3D. Cap 310 and shoulder 313 are formed from a single piece of plastic. Shoulder portion 313 provides the tamper band and is secured to the skirt portion 312 of the cap by a reduced thickness area 319 formed by an inner annular groove 314 in the cap. In the configuration shown in FIG. 3C, micro-capsuled material 320 is applied, when wet, to the surface 317 of shoulder 313 and/or the inside surface 315 of skirt 312. Then, shoulder portion 313 is folded up (as shown in FIG. 3D) about the groove 314, bringing surfaces 315 and 317 together. The micro-capsule material 320 is then allowed to dry and the cap is sealed to the bottle. When the cap is opened the cap breaks at the reduced thickness area 319, groove 314, allowing the shoulder 313 to separate from the skirt 312 and release the aroma material as described above.

Figure 3E:
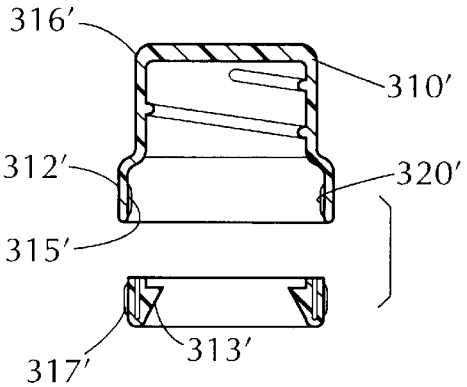
FIG. 3E illustrates another method of manufacturing the cap shown in FIG. 3A.

FIG. 3E illustrates an alternative way to form the cap shown in FIG. 3A, using a two part assembly. The first part includes the cap 310' with a base portion 312'. The second part is the tamper band 313' whose outer diameter is smaller than the inner diameter of the base portion 312'. The microencapsulated material 320' is applied, when wet, to the outer surface 317' of band 313' and/or the inner surface 315' of base portion 312'. The tamper band 313' is then inserted into base portion 312', and the micro-capsule material 320' is allowed to dry, which causes band 313' to adhere to the base portion 312'.

Figure 4A:
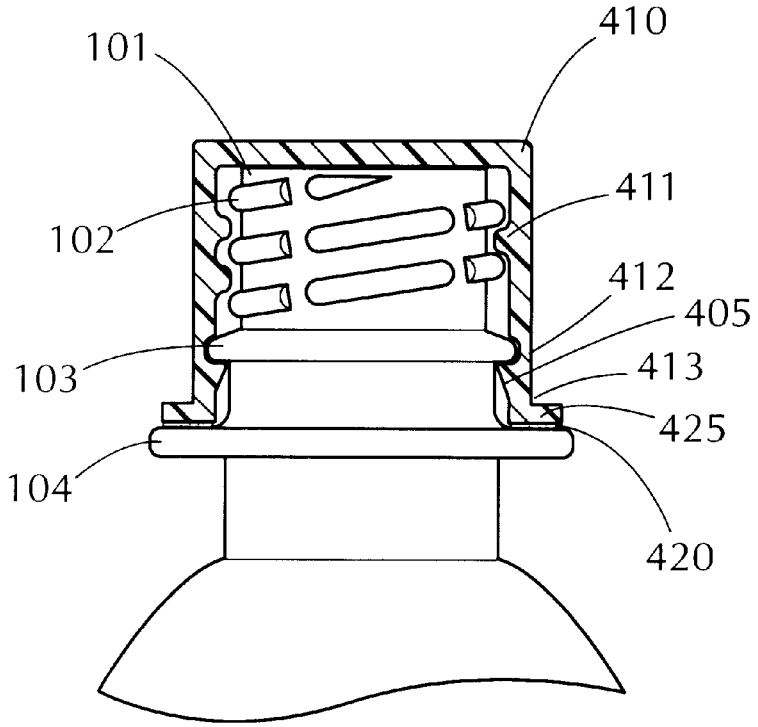
FIG. 4A is a partial sectional view similar to FIG. 1B of a fourth embodiment of a bottle top and cap in accordance with the present invention.
Figure 4B:
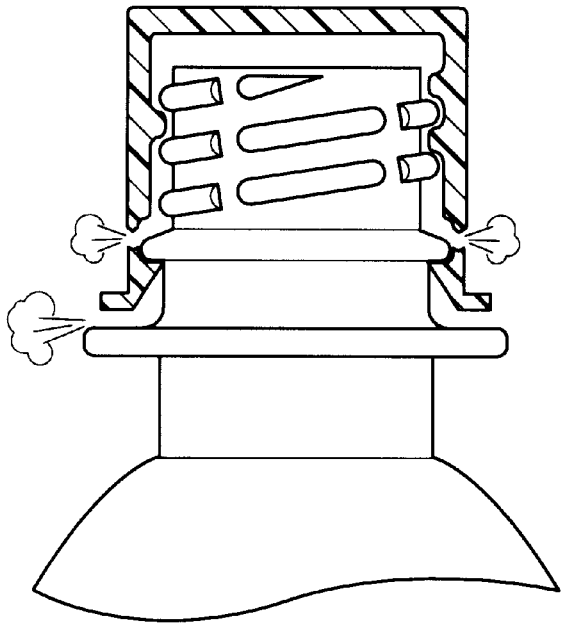
FIG. 4B is a partial view of the bottle top and cap shown in FIG. 4A illustrating the rupture of the cap as it is unscrewed.

FIGS. 4A and 4B illustrate a fourth embodiment of the present invention. Here again bottle neck 101, thread 102, and flanges 103 and 104 are the same as the corresponding parts in the first embodiment, described above. In this case a cap 410 is applied to neck 101 so that thread 411 mates with thread 102 of the bottle. Cap 410 includes a tamper band 413 located below flange 103 when cap 410 is assembled on the bottle. In this embodiment the lower surface 425 of tamper band 413 has the microencapsulated material applied to it as layer 420. That material acts like glue, securing the bottom of the tamper band to flange 104. The tamper band has an internal shoulder 405 which engages the underside of flange 103 when the bottle is sealed. When the cap is twisted off, the initial upward movement and rotation of band 413 pulls or snaps it away from flange 104 and causes the microcapsules in layer 420 to burst, releasing the aroma. Further rotation of the cap pulls the tamper band 413 up until its movement is blocked by flange 103. Further rotation of the cap will snap the band from the cap (as seen in FIG. 4B).

Because the microencapsulated material 420 acts like glue, cap 410 must be assembled onto bottle top 101 when the layer 420 is still wet. Then layer 420 must be allowed to dry. The PET surface of the bottle must be prepared, as described above for the first embodiment, so that layer 420 will adhere to the PET. The surface of the cap 410 may also require similar preparation, depending on the material used to make the cap 410.

Figure 5A:
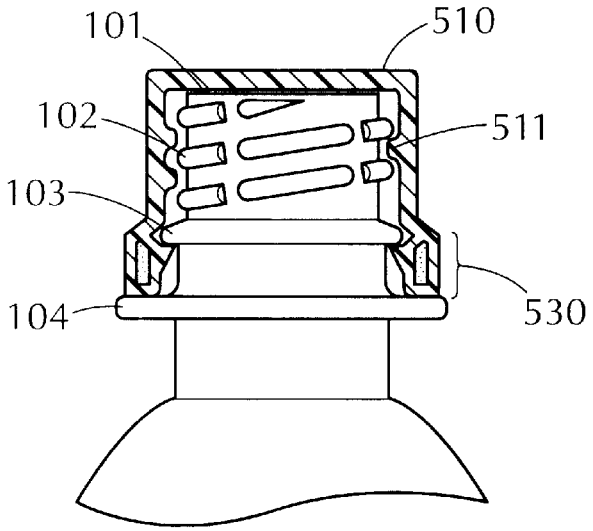
FIG. 5A is a partial sectional view of a fifth embodiment of a bottle top and cap in accordance with the present invention.
Figure 5B:
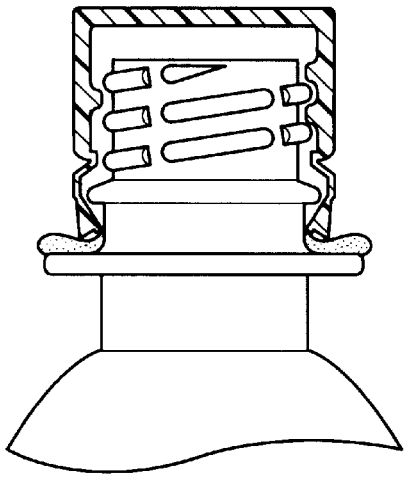
FIG. 5B illustrates the release of aroma material from the cap shown in FIG. 5A when the cap is partially unscrewed.
Figure 5C:
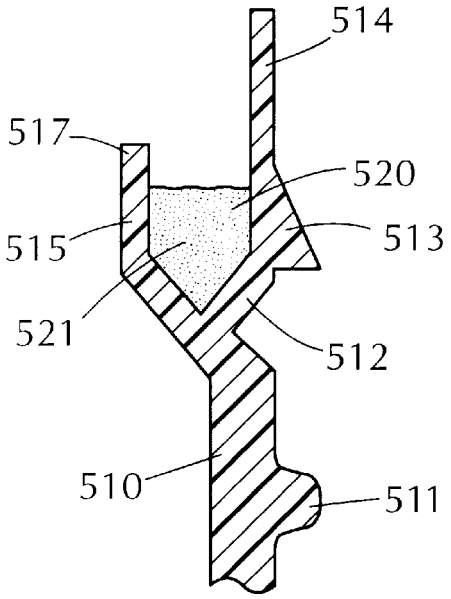
FIGS. 5C and 5D are enlarged detail views showing the sequence of steps in the manufacturing process of the cap shown in FIG. 5A, for containing the aroma liquid prior to its release.

FIGS. 5A and 5B illustrate a fifth embodiment of the present invention. Bottle neck 101, thread 102, and flanges 103 and 104 in this embodiment are the same as the corresponding parts in the first embodiment, described above. In this embodiment a cap 510 is provided. The lower end of cap 510 includes a foldable structure 530 which is used to contain the aroma material. This structure is shown in detail in FIGS. 5C and 5D where the cap is shown in its inverted position. As seen there, the foldable structure 530 includes a first outer leg 515 and a second inner leg 514 which define a well 521 therebetween. The well is filled with a liquid aromatic substance 520.

Figure 5D:
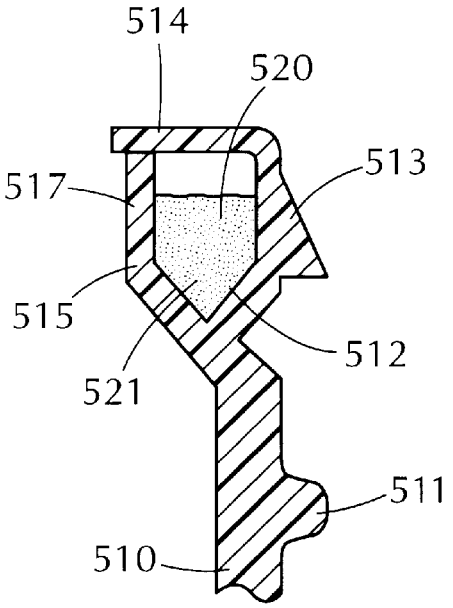

Leg 514 includes a shoulder 513 and a weakened leg section 512. After well 521 is filled (in any convenient manner) wall 514 is folded over the top of the well 521 to seal the well, as shown in FIG. 5D. Any suitable sealant, or sonic welding, can be used where leg 514 engages the end 517 of leg 515. Cap 510 can then be installed on the bottle so that its threads 511 mate with the thread 102 of the bottle. When cap 510 is installed, shoulder 513 is located under bottle flange 103, as see in FIG. 5A.

When the cap 510 is twisted off, the tamper band portion of the cap will be urged upwards against flange 103. When sufficient twisting force is applied, the weakened leg section 512 (which is weaker than the other parts of the cap) will break, as shown in FIG. 5B. When the weakened leg section 512 breaks and moves from the position shown in FIG. 5A to the position shown in FIG. 5B, the well is torn open, releasing the liquid aromatic substance.

While the present invention has been described above with reference to the specific embodiments, it is to be understood that the invention is not limited to those precise embodiments, and that various changes and modifications can be effected therein without departing from the scope or spirit of the present invention.

We claim:

1. An aroma release device, comprising a three-dimensional container for holding a liquid, said container having a neck including an open top;

closure means for selectively opening and closing said top, said closure means being rotatable mounted on said neck; and a layer of microencapsulated aroma material, containing aroma microcapsules, secured to at least one of said top and closure means, whereby when said closure means is rotated on said neck for removal from said top to open said container and dispense the contents thereof, at least some of the aroma microcapsules are ruptured and an aroma is released.

2. The device as defined in claim 1, wherein said neck comprises a threaded neck on said bottle.

3. The device as defined in claim 2, wherein said closure means comprises an internally threaded cap rotatably secured to said threaded neck.

4. An aroma release device, comprising:

a container having an open top;

closure means for selectively opening and closing said top; and a layer of microencapsulated aroma material, containing aroma microcapsules, secured to at least one of said top and closure means, whereby when said closure means is removed from said top to open said container, at least some of the aroma microcapsules are ruptured and an aroma is released;

said container being a bottle and said open top comprising a threaded neck on said bottle;

said closure means comprising an internally threaded cap rotatably secured to said neck; and said bottle including a neck flange beneath the threaded portion of the neck, said cap including a tamper ring including a shoulder located below the flange when said cap is on said bottle, and the microencapsulated material being located on at least one of the flange and the shoulder, whereby rotation of said cap to remove it from said bottle creates relative movement of the shoulder with respect to the flange to rupture at least some of the aroma microcapsules.

5. The device as defined in claim 4 wherein the microencapsulated material contains polyvinyl alcohol.

6. The device as defined in claim 1, wherein at least one surface of one of said container and closure means to which the microencapsulated material is secured is etched to allow the microencapsulated material to adhere thereto.

7. The device as defined in claim 1, wherein at least one surface of one of said container and closure means to which the microencapsulated material has a primer coating to allow the microencapsulated material to adhere thereto.

8. The device as defined in claim 1, wherein at least one surface of one of said container and closure means to which the microencapsulated material is secured is roughened to allow the microencapsulated material to adhere thereto.

9. The device as defined in claim 1, wherein the aroma microcapsules have a diameter between about 20 and about 300 microns.

10. The device as defined in claim 1, wherein the aroma microcapsules have a diameter between about 60 and about 100 microns.

11. An aroma release device, comprising:

a container having an open top;

closure means for selectively opening and closing said top; and a layer of microencapsulated aroma material, containing aroma microcapsules, secured to at least one of said top and closure means, whereby when said closure means is removed from said top to open said container, at least some of the aroma microcapsules are ruptured and an aroma is released;

said container being a bottle and said open top comprising a threaded neck on said bottle;

said closure means comprising an internally threaded cap rotatably secured to said neck; and said bottle including an annular neck flange below the threaded portion of the neck, said cap including an annular tamper band located below the flange when said cap is on said bottle, said tamper band having an inner diameter smaller than a diameter of the flange, whereby said tamper band will rub against the underside of the flange when said cap is twisted off, and the microencapsulated material is secured to the underside of the flange whereby at least some of the aroma microcapsules will burst as a result of said tamper band rubbing against the microencapsulated material when said cap is twisted off.

12. An aroma release device, comprising:

a container having an open top;

closure means for selectively opening and closing said top: and a layer of microencapsulated aroma material, containing aroma microcapsules, secured to at least one of said top and closure means, whereby when said closure means is removed from said top to open said container, at least some of the aroma microcapsules are ruptured and an aroma is released;

said container being a bottle and said open top comprising a threaded neck on said bottle;

said closure means comprising an internally threaded cap rotatably secured to said neck: and said bottle including an annular flange located on the neck of said bottle, below the threads, said cap including an annular tamper band located below the flange when said cap is on said bottle, said tamper band having an inner diameter smaller than a diameter of the flange, said cap further including an annular pleat between said cap and said tamper band, the pleat having opposed surfaces located adjacent to each other when said cap is initially placed on said bottle, and the microencapsulated material being secured to the opposed surfaces whereby when said cap is twisted off the neck, the flange engages the shoulder of said tamper band, resisting movement of said tamper band off said bottle, and the pleat opens as said cap is turned so that at least some of the aroma microcapsules will burst.

13. An aroma release device, comprising:

a container having an open top;

closure means for selectively opening and closing said top; and a layer of microencapsulated aroma material, containing aroma microcapsules, secured to at least one of said top and closure means, whereby when said closure means is removed from said top to open said container, at least some of the aroma microcapsules are ruptured and an aroma is released;

said container being a bottle and said open top comprising a threaded neck on said bottle;

said closure means comprising an internally threaded cap rotatably secured to said neck; and said bottle including an annular flange located on the neck of said bottle, below the threads, said cap including an annular tamper band located below the flange when said cap is on said bottle, said tamper band having an inner diameter smaller than a diameter of the flange, defining a shoulder beneath the flange, and an outer surface, said cap having a skirt portion that extends below the flange, and an inner surface of larger diameter than said tamper band to encircle said tamper band, and the microencapsulated material being secured to both the outer surface of said tamper band and the inner surface of the skirt portion of said cap, whereby when said cap is rotated to open said bottle, upward movement of said tamper band is blocked by the flange and said inner and outer surfaces will move relative to one another so that at least some of the aroma microcapsules will burst.

14. An aroma release device, comprising:

a container having an open top;

closure means for selectively opening and closing said top; and a layer of microencapsulated aroma material, containing aroma microcapsules, secured to at least one of said top and closure means, whereby when said closure means is removed from said top to open said container, at least some of the aroma microcapsules are ruptured and an aroma is released;

said container being a bottle and said open top comprising a threaded neck on said bottle;

said closure means comprising an internally threaded cap rotatably secured to said neck; and said bottle including an annular flange located on the neck of said bottle, below the threads, said cap including a lower rim that extends close to the flange when said cap is on said bottle, and the microencapsulated material being secured to both the lower rim of said cap and an upper surface of the flange, whereby when said cap is rotated to open said bottle, upward movement of said cap will pull the microencapsulated material apart, so that at least some of the aroma microcapsules will burst as a result of a separation of the lower rim of said cap from the flange.

15. An aroma release device, comprising:

a bottle having an open top with a threaded neck and a flange beneath the threaded portion of the neck;

an internally threaded cap rotatably secured to said threaded neck for selectively opening and closing said top, said cap having a plurality of walls forming a cavity therein, said cap having an annular shoulder located below the flange when said cap is on said bottle, the shoulder having an inner diameter smaller than a diameter of the flange; and an aromatic substance confined in said cavity, whereby when said cap is rotated to open said bottle said cap moves upward while the shoulder is held down by the flange, and movement of said cap with respect to the shoulder tears at least one of the cavity walls, releasing said aromatic substance.

16. The device as defined in claim 15, wherein said aromatic substance is a liquid.

17. An aroma release device, comprising:

a bottle having an threaded neck and a flange beneath the threaded portion of the neck;

an internally threaded cap rotatably secured to said threaded neck for selectively opening and closing said bottle, said cap including an annular tamper ring having a shoulder located below the flange when said cap is on said bottle, the shoulder having an inner diameter smaller than a diameter of the flange, whereby said tamper band will rub against the underside of the flange when said cap is twisted off; and a layer of microencapsulated aroma material, containing aroma microcapsules, secured to the underside of the flange, whereby rotation of said cap to remove it from said bottle creates relative movement of the shoulder with respect to the flange and causes the shoulder to rub against the microencapsulated material, whereby at least some of the aroma microcapsules will burst.

18. The device as defined in claim 17, wherein the microencapsulated material contains polyvinyl alcohol.

19. The device as defined in claim 17, wherein the underside of the flange is laser etched to allow the microencapsulated material to adhere thereto.

20. The device as defined in claim 17, wherein the underside of the flange is primed with primer to allow the microencapsulated material to adhere thereto.

21. The device as defined in claim 17, wherein the underside of the flange is roughened by physical abrasion to allow the microencapsulated material to adhere thereto.

22. The device as defined in claim 17, wherein the aroma microcapsules have a diameter between about 60 and about 100 microns.

23. A method of delivering an aroma in a vicinity of a bottle containing a liquid, the bottle having a three-dimensional form, a cylindrical threaded neck and an associated twist-off cap, the method comprising the step of:

applying a material containing aroma microcapsules to at least one of two opposed surfaces on the cylindrical neck and the twist-off cap whereby at least some of the aroma microcapsules will be ruptured by the relative movement of the cap and bottle during opening of the bottle.

24. A method of delivering an aroma in a vicinity of a bottle, the bottle having a threaded neck and an associated twist-off cap, the method comprising the step of:

applying a material containing aroma microcapsules to at least one of two opposed surfaces on the neck and the cap whereby at least some of the aroma microcapsules will be ruptured by the relative movement of the cap and bottle during opening of the bottle, and wherein the material is applied to an underside of a flange of the bottle.

25. The method according to claim 24, further comprising the step of applying primer to the underside of the flange before the step of applying the material is performed.

26. The method according to claim 24, further comprising the step of laser etching the underside of the flange before the step of applying the material is performed.

27. The method according to claim 24, further comprising the step of roughening the underside of the flange by physical abrasion before the step of applying the material is performed.

* * * * *